US005904963A

United States Patent [19]

Blatter

[11] Patent Number: 5,904,963

[45] Date of Patent: May 18, 1999

[54] BLOCK HAVING HEAT INSULATING INNER CAVITIES

[75] Inventor: Eduard Blatter, Duedingen, Switzerland

[73] Assignee: Ziegeleien Freiburg & Lausanne AG Duedingen, Duedingen, Switzerland

[21] Appl. No.: 08/499,476

[22] Filed: Jul. 7, 1995

[30] Foreign Application Priority Data

Jul. 8, 1994 [DE] Germany ..... 44 23 716

[51] Int. Cl.[6] ..... B32B 17/00

[52] U.S. Cl. ..... 428/34.4; 428/34.6; 428/53; 428/116; 428/426; 428/432; 428/701; 428/702; 52/306; 52/561; 427/230; 427/236; 427/237; 427/255

[58] Field of Search ..... 428/116, 34.4, 428/34.6, 702, 701, 53, 426, 428, 432; 52/306, 561; 427/230, 236, 237, 255

[56] References Cited

U.S. PATENT DOCUMENTS

| | | | |
|---|---|---|---|
| 4,956,217 | 9/1990 | Heitkamp | 428/116 |
| 5,499,478 | 3/1996 | Rimmele | 52/606 |

FOREIGN PATENT DOCUMENTS

| | | |
|---|---|---|
| 946387 | 6/1949 | France . |
| 2192226 | 7/1972 | France . |
| 325293 | 9/1920 | Germany . |
| 2124350 | 1/1973 | Germany . |
| 1962625 B2 | 2/1979 | Germany . |
| 3621114 A1 | 2/1988 | Germany . |
| 8427060 | 11/1989 | Germany . |
| 289038 A5 | 4/1991 | Germany . |
| 289039 A5 | 4/1991 | Germany . |
| 4135055 C1 | 5/1993 | Germany . |
| 4225970C1 | 4/1994 | Germany . |
| 0599283A3 | 6/1994 | Germany . |
| 8903370 | 6/1992 | Sweden . |
| 86156 | 9/1920 | Switzerland . |
| 476181 | 9/1969 | Switzerland . |
| 482882 | 1/1970 | Switzerland . |
| 516057 | 1/1972 | Switzerland . |

*Primary Examiner*—Timothy M. Speer
*Attorney, Agent, or Firm*—Spencer & Frank

[57] ABSTRACT

A brick which can be laid with other similar bricks for forming a heat-insulating masonry work structure. The brick includes a plurality of webs defining empty inner cavities therebetween, the cavities having heat-insulating properties and further defining inner surfaces and a width of more than 8 mm. A heat-reflecting coating is disposed on the inner surfaces of the cavities. The masonry work structure may include a brick laying material for laying the bricks such that the bricks do not fill with the material and do not clog up with dirt, the brick laying material including one of bonding mortar, thin-bed mortar, mid-bed mortar and fibrous mortar. The coating may be applied to the inner surfaces of the cavities by one of vapor deposition, spraying and bonding on as a thin film, and may further be fired. The coating may further be sprayed, coextruded and spread and thereafter fired. The brick may be produced either by applying a glaze on the inner surfaces of the cavities as a base for the coating and thereafter applying the coating on the glaze, or by admixing a water-soluble component with a raw material clay for forming a brick mixture, forming the brick mixture into a brick shape and thereafter effecting a migration of the component onto the inner surfaces of the cavities by drying and firing the brick shape.

14 Claims, 3 Drawing Sheets

BLOCK HAVING HEAT INSULATING INNER CAVITIES

FIELD OF THE INVENTION

The invention relates to a cuboidal block having inner cavities which carry out a heat-insulating function and are of a width of more than 8 mm. A block of this type may also comprise a brick. The block is used for erecting heat-insulating walls and is laid with bonding mortar, thin-bed mortar, mid-bed mortar or a fiber-containing mortar, which mortar does not fall into the cavities. The cavities can run vertically parallel with the wall surface, as in the case of so-called vertically perforated bricks, or alternatively horizontally.

BACKGROUND OF THE INVENTION

In the case of conventional insulating blocks, for example perforated bricks, gas-concrete blocks and blocks including cement-bound lightweight building materials, the attempt is made to optimize the heat-insulating capacity by using as lightweight a building material as possible. Consequently, use is made of high-porosity clays for bricks, foamed concrete, pumice, pearlite or the like. However, this method is restricted by virtue of the limited resistance to compression of the lightweight building materials.

The prior art further improves the heat-insulating capacity of a given block by a skilled arrangement of air slots which pass through completely, or at least to a major extent, from one side of the block to the other and transversely with respect to the heat-flow direction. In particular, the heat-insulating capacity is improved by slot-shaped cavities which are aligned in the longitudinal direction of the block and are offset with respect to one another transversely with respect to the heat-flow direction. However, the elongate cavities which are produced in bricks by the extrusion process and thus pass through the bricks weaken the stability, in particular the resistance to transverse tension, of the insulating block. Consequently, it is not possible to go below a minimum cross-sectional surface area of heat-conducting webs in the heat-flow direction.

It is known that, with a predetermined thickness of the longitudinal webs running transversely with respect to the heat-flow direction, the optimum average slot width or the average number of slots following one after the other in the heat-flow direction can be calculated (Swiss Patent Specification 476 181, 482 882 and 516 057). The average slot width is understood as being the cross-sectional surface area of a usually elongate cavity divided by its greatest extent transverse to the heat-flow direction. The number of slots is averaged over a multiplicity of cuts through the brick which are guided in the heat-flow direction, and corresponds to a more conventional parameter, namely the number of slot rows. The cavity cross-sections are usually of shapes elongated transverse to the heat-flow direction, for example ellipses, rectangles, trapeziums, cuboids, triangles, etc. The cavities may also be square, round or of shapes with five, six and more sides.

In the case of blocks consisting of fired clay, web thicknesses of 6 mm and more are conventional. If the web thickness is reduced, for example to 4 or 2 mm, then, following on from the abovementioned patent specifications, the optimum number of slots increases in an extremely pronounced manner, with the result that it is no longer possible to produce bricks with the theoretically determined optimum number of slot rows since overly high pressures occur during the extrusion of the clay compositions. For example, for a brick of a thickness of 30 cm, with the web thickness being 2 mm according to Leitner (see abovementioned CH-PS 516 057) or Amrein (see abovementioned CH-PS 476 181), the slot width would have to be 3.5 mm. Consequently, over 50 rows of slots would be necessary in order approximately to reach the theoretically determined maximum. Bricks of a thickness of 30 cm which are produced today usually have 17 rows of slots, and not more than 21 rows of slots. 30 rows of slots would, at this moment in time, constitute a significant limit to producibility.

A further possibility for producing heat-insulating blocks consists in producing the block with a plurality of larger cavities and, in order to restrict the heat loss in the cavities, filling said cavities subsequently with insulating inserts consisting of extremely different materials, this, however, constituting an operation involving a high degree of outlay.

Conventional insulating blocks which have been optimized with the above methods achieve coefficients of thermal conductivity of 0.12 W/mK or worse, at best 0.15 W/mK in the case of bricks.

SUMMARY OF THE INVENTION

The object of the invention is to provide insulating blocks which can be subjected to the conventional extent of static loading, but have a considerably better heat-insulating capacity than before and can be easily produced.

Starting from a block of the type described above, the object of the invention is achieved by providing a brick which can be laid with other similar bricks for forming a heat-insulating masonry work structure. The brick includes a plurality of webs defining empty inner cavities therebetween, the cavities having heat-insulating properties and further defining inner surfaces and a width of more than 8 mm. A heat-reflecting coating is disposed on the inner surfaces of the cavities. The masonry work structure may include a brick laying material for laying the bricks such that the bricks do not fill with the material and do not clog up with dirt, the brick laying material including one of bonding mortar, thin-bed mortar, mid-bed mortar and fibrous mortar. The coating may be applied to the inner surfaces of the cavities by one of vapor deposition, spraying and bonding on as a thin film, and may further be fired. The coating may further be sprayed, coextruded and spread and thereafter fired. The brick may be produced either by applying a glaze on the inner surfaces of the cavities as a base for the coating and thereafter applying the coating on the glaze, or by admixing a water-soluble component with a raw material clay for forming a brick mixture, forming the brick mixture into a brick shape and thereafter effecting a migration of the component onto the inner surfaces of the cavities by drying and firing the brick shape.

The heat transfer in an insulating block of the above type takes place, on the one hand, by thermal conduction in the basic material, i.e. in the webs, and, on the other hand, by convection, conduction and radiation in the cavities. Recent findings have shown that, in particular in the case of blocks with thin webs, the proportion of heat transfer by way of the air-filled dark cavities in relation to the overall heat transfer is considerable. Furthermore, the heat transfer in the cavities by radiation is surprisingly high. This outweighs the proportions of heat transfer by conduction in the air and by convection. In slots of a height of 25 cm and up to a slot width of approximately 3 cm, the heat transfer by convection is small in comparison with the radiant component and is also smaller than the transfer by way of heat conduction in the air. The large theoretical number of webs of a block optimized in accordance with the abovementioned specifications is basically only necessary because the webs, in the same way as screens, interrupt the heat radiation again and again. The same occurs in the case of known blocks whose cavities are filled with insulating materials. For cavities which are considerably wider than 3 cm, the insulating inserts do indeed also prevent convection, but when all the cavities are filled, in particular those of a width of around 3 cm and less, the insulating inserts primarily effect interruption of the heat radiation. The still air alone would be an optimum insulator without convection and radiation.

It is, indeed, known in general, for insulating purposes, to provide heat-reflecting surfaces on the objects which are to be protected against heat radiation, in particular in the case of high temperatures and against insolation. Based on the abovementioned finding that the heat radiation in the cavities has a surprisingly large effect even at room temperature, the invention proposes to utilize this possibility of reducing the heat radiation by heat-reflecting surfaces in the cavities of insulating blocks. It should be noted, in this respect, that the optimum number of rows of perforations has to be newly defined in order to make maximum utilization of the coating.

Fortunately it has been found that blocks having inner cavities which are provided with a heat-reflecting coating may be provided with wider cavities than if the cavities are not coated. It is thus proposed, in contrast to the formulae according to the Swiss Patent Specifications mentioned in the introduction, to provide fewer and wider rows of slots. Consequently, further heat-conducting webs can be eliminated and the heat-insulating capacity of the block can be further increased. These wide inner cavities not only bring about an additional increase in insulation but also improve the producibility of the block.

The coated inner cavities do not have to be provided with additional insulating inserts since the coating of the cavities sufficiently reduces the heat exchange by radiation between the mutually opposite webs which bound the cavity. However, the most favorable thermal conduction values are achieved with cavity widths of below 3 cm because otherwise convection currents can arise in the cavity. For the same reason, the height of the cavity is to be restricted to one block height of usually 25 cm, and care should be taken that, during laying, the cavities do not connect to form channels, but are separated from one another by a layer of mortar. The above be achieved, in particular, in that, in addition to large cavities of a width of up to three centimeters, a block also exhibits small cavities which, during the laying operation, are closed by the mortar which is used and cover over the large cavities. In each case, care should be taken that not too much mortar falls into the cavities, soils them, partially fills them and thus reduces their insulating properties. In particular, it is expedient to provide gripping perforations with a heat-reflecting coating and to arrange the perforations such that they do not cover over one another when laid conventionally. Advantageously, such blocks are laid by the immersion method, i.e. they are immersed in the mortar to an extent of only a few millimeters and are laid with the mortar adhering to the block.

By largely suppressing the heat radiation in the cavities, a reduction, by more than half, of the overall heat transfer in the cavities in the case of conventional climatic temperatures is possible. For example, the coefficient of thermal conductivity for internally coated slots of a width of approximately 2 cm is less than 0.05 W/mK instead of more than 0.11 W/mK for non-coated cavities.

Upon using the above method for good insulating blocks which are fabricated in the traditional way from lightweight building materials and, in terms of the perforation width and the number of rows of perforations, take account of the heat-reflecting coating, it is possible to produce blocks for insulating walls which can be subjected to static loading, without additional insulation, with coefficients of thermal conductivity of below 0.10 W/mK.

In a further development of the invention, it is proposed that, in addition to the cavities, the abutment sides of the insulating blocks are also provided with a heat-reflecting coating. This applies, in particular, to blocks which exhibit, on the abutment sides, depressions which, after being positioned against a following block in the same course, combine with the depressions thereof to form closed cavities. Consequently, said cavities are then also coated on their inner surfaces.

The heat-reflecting layer may contain aluminium or a similar heat-reflecting component. It is also possible to use various oxides, such as zirconium oxide, titanium oxide, magnesium oxide, etc. The heat-reflecting component may be embedded in the clay, in a glaze, in a paint or in any covering layer, or it may be connected to a bonding layer.

A preferred method of applying the heat-reflecting layer comprises the step of applying the layer on the traditionally produced insulating block by vapor deposition or spraying. In particular in the case of bricks, it is proposed that, as long as a smooth surface is necessary, a glaze be applied, before the heat-reflecting layer is applied, as a base for the latter. The glaze forms a hard, smooth base onto which, for example, aluminium may then be applied by vapor deposition or spraying. Instead of a vapor deposition, specific ceramic or inorganic compositions may also be sprayed thereon and subsequently fired in.

The cavities may also be coated by spraying on a synthetic-resin-based paint with reflecting components, since the coating is not exposed to high temperatures.

A further method of coating the surfaces of insulating blocks, in particular bricks comprises the steps of admixing water-soluble products with a low emission coefficient with the clay or the composition which is to be molded. During the drying and firing process, these products migrate onto the surfaces of the green brick and coat the latter uniformly. If a coating is not desired on the outer surfaces parallel to the walls, the coating can be brushed off or ground off.

A further coating possibility comprises the step of coextruding a glaze which contains the heat-reflecting component with the green brick. In this arrangement, the glaze is pressed on under high pressure via the cores of the mouthpiece.

The effectiveness of a heat-reflecting coating can be specified numerically by the so-called emission coefficient $\epsilon$. In the case of fired clay or cement-bound lightweight building materials without coating, this coefficient is 0.93, but it is only 0.05 in the case of aluminium-coated surfaces. Coatings with aluminium bronze have an emission coefficient $\epsilon$ of approximately 0.20 and are thus entirely suitable for coating the cavities.

BRIEF DESCRIPTION OF THE DRAWINGS

Exemplary embodiments of insulating blocks used to realize the invention are described hereinbelow with reference to the drawings where.

DETAILED DESCRIPTION OF THE INVENTION

Figure 1:
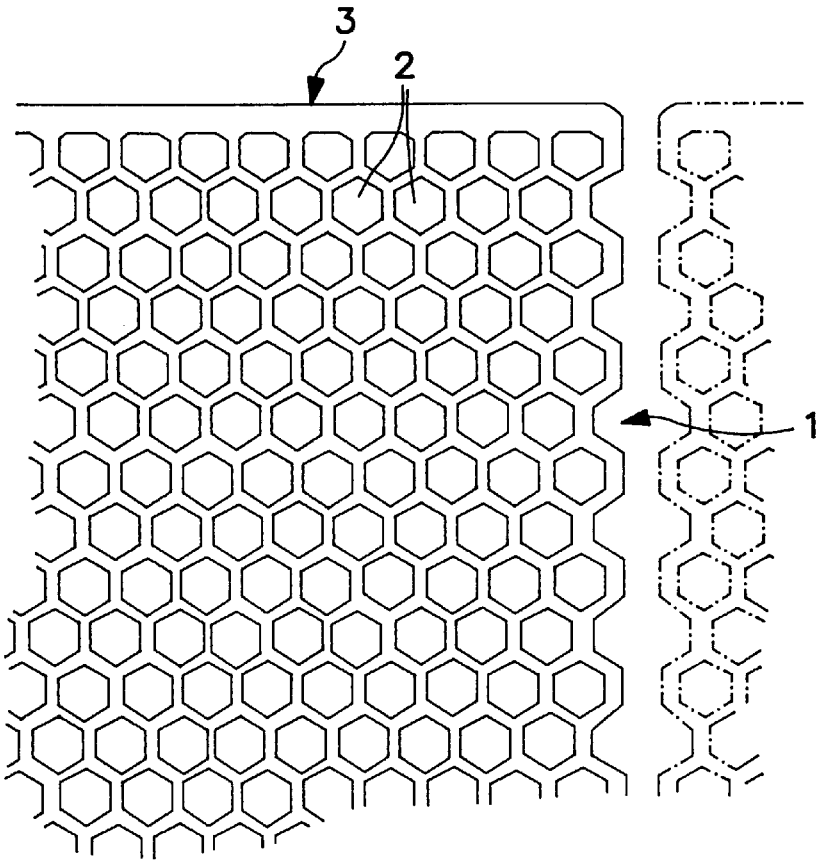
FIG. 1 shows the plan view of a fragment of a vertically perforated brick with hexagonal cavities arranged in honeycomb form (honeycomb brick)
Figure 2:
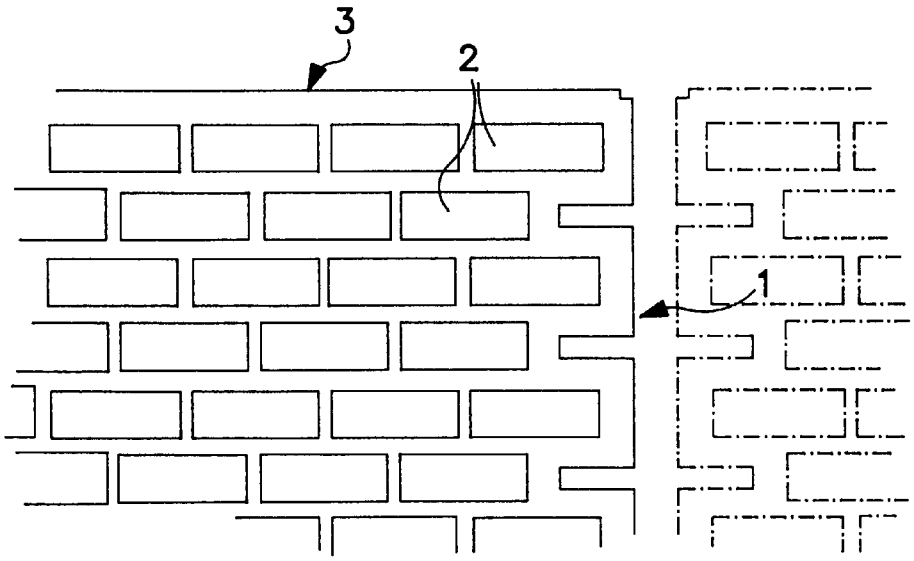
FIG. 2 shows the plan view of a vertically perforated brick with offset rectangular cavities (slotted brick)
Figure 3:
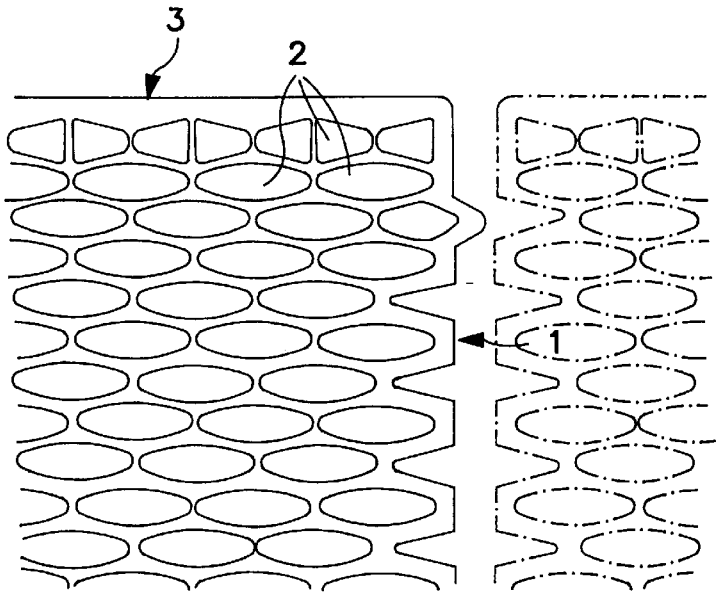
FIG. 3 shows the plan view of a vertically perforated brick with elliptical cavities.

In FIGS. 1 to 3, an adjacent brick is indicated by chain-dotted lines in each case. The cavities are provided with heat-reflecting coatings on their wall surfaces. Of course, a corresponding coating is possible for any cavity shape.

On the abutment surfaces 1, the bricks are configured such that the adjacent brick ends complete the respective perforation pattern. Accordingly, a heat-reflecting coating is applied not only to the inner surfaces of the perforations 2, which are of different cross-sectional shapes and run perpendicularly with respect to the bearing surface of the brick, but also to the abutment surfaces 1, in order also to cover the inner surfaces of the trapezoidal, rectangular or wedge-shaped grooves in which, after the bricks have been joined together, heat transfer likewise takes place by radiation. On the fair-faced sides 3, the wall thicknesses of the webs have been selected to be of a thickness of 6 mm. The wall thickness of the inner webs is 3 mm.

The honeycomb brick according to FIG. 1 has 15 rows of perforations. A masonrywork structure erected using such bricks achieves, with a wall thickness of 30 cm, non-plastered, and taking account of the standard heat-transfer coefficients and in the case of a coefficient of thermal conductivity of the body material of 0.30 W/mK, with non-reflecting inner surfaces, a k-value of 0.38 $W/m^2K$. The emission coefficient of the clay surface is 0.93. If the surfaces are of a reflective design with an emission coefficient $\epsilon$=0.1, then, instead of 0.38 $W/m^2K$, a k-value of 0.25 $W/m^2K$ is achieved.

Figure 4:
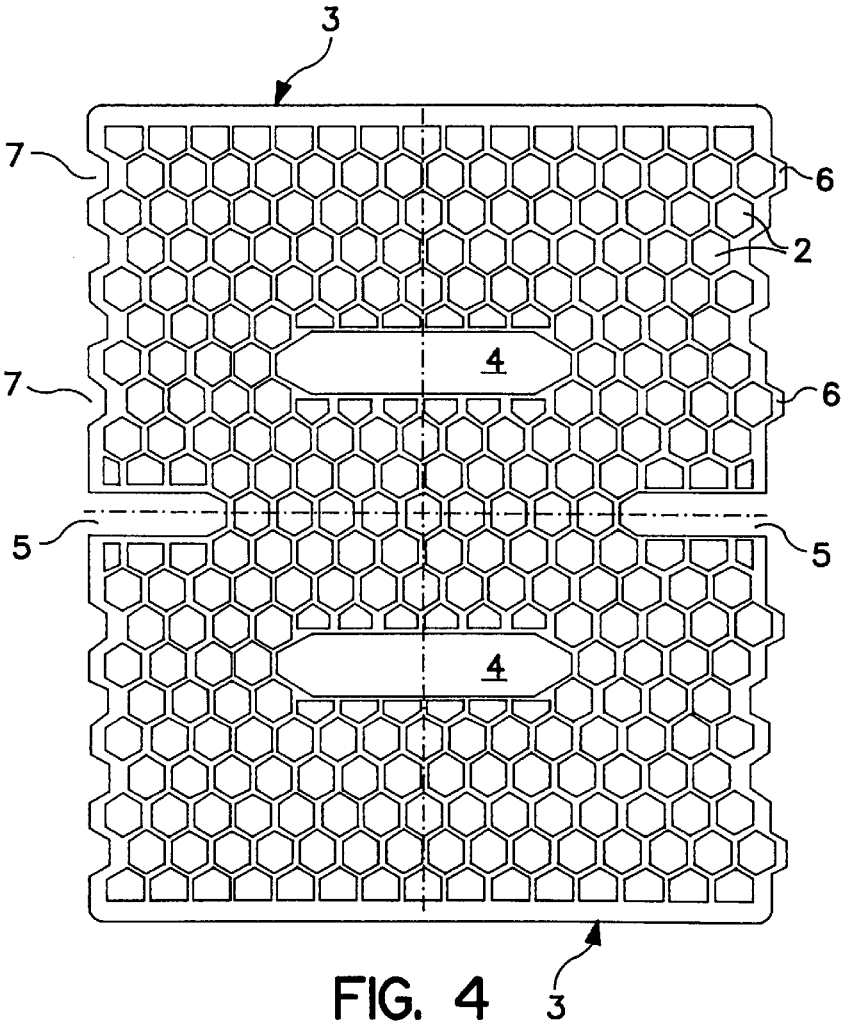
FIG. 4 shows, on a smaller scale, the plan view of a whole brick having gripping perforations.

In the case of the brick represented in FIG. 4, the honeycomb is even smaller. On a true scale, the outline of the brick measures 30×27 cm. There are 21 rows of perforations in the heat-flow direction. A further special feature in the case of this brick is constituted by two inserted gripping perforations 4 and, on each of the abutment sides, a half-cavity 5. When a further brick is added, the half-cavities supplement one another to form a whole cavity. Of course, all the cavities and the abutment sides may be provided with heat-reflecting coatings here as in the case of the preceding examples. However, a very favourable effect can be expected if it is only the gripping perforations 4 and the half-cavities 5 which are provided with corresponding coatings. On one abutment side, the brick has four vertical tongues 6 which each contain a hexagonal cavity and engage into corresponding grooves 7 of the adjacent brick.

Figure 5:
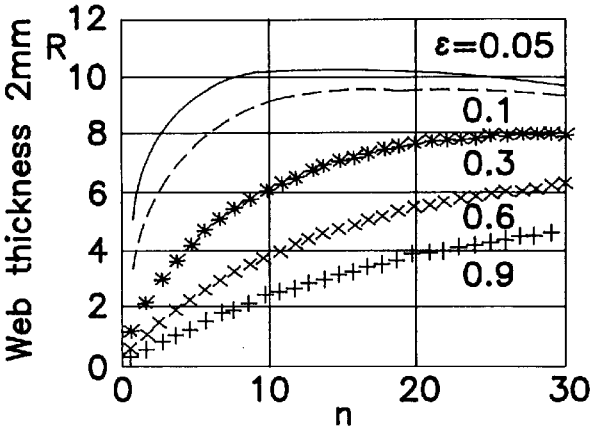
FIG. 5 shows a graph which, for a vertically perforated brick of defined dimensions and with specific preconditions includes a web thickness of 2 mm, represents the arithmetical dependence of the resistance to heat transmission R on the number n of the rows of perforations.
Figure 6:
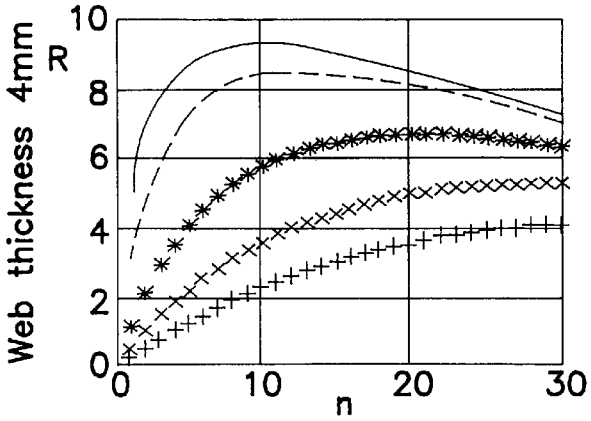
FIGS. 6 and 7 show graphs similar to the graph of FIG. 5 for web thicknesses of 4 mm and 6 mm, respectively.
Figure 7:
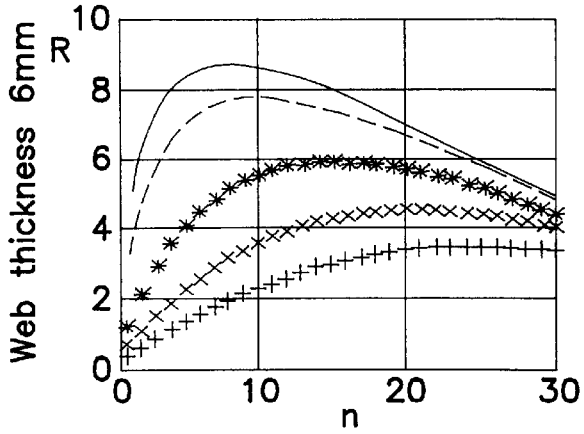

FIGS. 5, 6 and 7 show in graphs the effect of the heat-reflecting coating of the cavities on the resistance to heat transmission R and on the theoretically optimum number n of rows of perforations of a block of a width of 30 cm and a height of 25 cm having different web widths. These representations are valid under the following preconditions: the coefficient of thermal conductivity of the body is 0.30 W/mK, the two outer border webs on the fair faces are double the thickness of the inner webs. Heat-conducting transverse webs made of clay are disregarded, as is the heat transfer by convection currents, as a result of which the validity of the graphs remains restricted to perforation widths of not more than 3 cm. In general, the resistance to heat transmission R of the brick increases as the quality of the coating increases, and the optimum number n of the rows of perforations decreases, the perforations becoming wider. The emission coefficient $\epsilon$, which, in this calculation, has changed between 0.05 and 0.9 with three intermediate stages, is specified in FIG. 5 with the individual curves. It can be seen that, as the quality of the heat-reflecting coating increases, i.e. as the emission coefficient $\epsilon$ becomes smaller, the resistance to heat transmission R not only becomes fundamentally greater, but the shape of the curve changes such that a maximum can indeed be seen. This is particularly noticeable in FIG. 7 (web thickness 6 mm).

It can be seen that, in the case of blocks with coated cavities, with more than 25 rows of slots, the resistance to heat transmission R decreases to a very pronounced extent with web thickness of 4 mm and 6 mm and still decreases even at 2 mm. It is thus not expedient to provide the cavities of blocks with a width of below 8 mm with heat-reflecting coatings.

I claim:

1. A brick adapted to be laid with other similar bricks for forming a heat-insulating masonry work structure, the brick comprising:

a brick body having a plurality of webs defining empty inner cavities therebetween, the cavities having heat-insulating properties and further defining inner surfaces and a width of more than 8 mm; and a heat-reflecting coating on the inner surfaces of the cavities.

2. The brick according to claim 1, further comprising:

a plurality of abutment surfaces disposed adjacent the webs; and a heat-reflecting coating on the abutment surfaces.

3. The brick according to claim 1, wherein the cavities are first cavities, the brick further comprising:

second cavities having inner surfaces and disposed such that, when the brick is laid with the other similar bricks, the second cavities do not lie directly above one another; and a heat-reflecting coating on the inner surfaces of the second cavities.

4. The brick according to claim 3, wherein the second cavities are gripping perforations.

5. The brick according to claim 1, wherein the heat-reflecting coating comprises one of a heat-reflecting metal and a heat-reflecting oxide.

6. The brick according to claim 5, wherein the heat-reflecting coating comprises aluminum.

7. A masonry work structure formed by laying bricks each of which is the brick according to claim 1, the structure further comprising a brick laying material for laying the bricks such that the bricks do not fill with the material and do not clog up with dirt, the brick laying material including one of bonding mortar, thin-bed mortar, mid-bed mortar and fibrous mortar.

8. A method of producing the brick according to claim 1, comprising the step of applying the heat-reflecting coating to the inner surfaces of the cavities by one of vapor deposition, spraying and bonding on as a thin film.

9. The method according to claim 8, further comprising the step of firing in the heat-reflecting coating.

10. A method of producing the brick according to claim 1, comprising the step of applying the heat-reflecting coating to the inner surfaces of the cavities by one of spraying, coextruding and spreading and by thereafter firing the heat-reflecting coating.

11. A method of producing the brick according to claim 1, comprising the steps of:

applying a glaze on the inner surfaces of the cavities as a base for the heat-reflecting coating; and thereafter applying the heat-reflecting coating on the glaze.

12. A method of producing the brick according to claim 1, comprising the steps of:

admixing a water-soluble heat-reflecting component with a raw material clay for forming a brick mixture;

forming the brick mixture into a brick shape; and effecting a migration of the heat-reflecting component onto the inner surfaces of the cavities by drying and firing the brick shape.

13. The brick according to claim 1, further comprising:

a pair of horizontal support surfaces disposed opposite one another;

a pair of side surfaces disposed opposite one another and adjoining the horizontal support surfaces, the side surfaces, together with side surfaces of the other similar bricks, forming wall surfaces of a built-up wall when the brick is laid with the other similar bricks to form the wall; and a pair of abutment surfaces disposed opposite one another and adjoining the horizontal support surfaces and the side surfaces, the abutment surfaces being adapted to abut corresponding abutment surfaces of the other similar bricks when the bricks is laid with the other similar bricks.

14. The brick according to claim 1, wherein the cavities extend through a height of the brick.

* * * * *